United States Patent [19]

Wang

[11] Patent Number: 5,004,070

[45] Date of Patent: Apr. 2, 1991

[54] ACOUSTIC BOARD

[76] Inventor: Hong-Jen Wang, 14-3, Fu-Hsing I Road, Kao-Hsiung City, Taiwan

[21] Appl. No.: 568,029

[22] Filed: Aug. 16, 1990

[51] Int. Cl.[5] ..... E04B 1/82

[52] U.S. Cl. ..... 181/286; 181/288; 181/292; 181/293

[58] Field of Search ..... 181/284, 286, 288, 289, 181/292, 293, 295

[56] References Cited

U.S. PATENT DOCUMENTS 2,308,817 1/1943 Richard ..... 181/292
4,600,078 7/1986 Wiort ..... 181/286

FOREIGN PATENT DOCUMENTS 1147491 4/1969 United Kingdom ..... 181/286

*Primary Examiner*—Benjamin R. Fuller
*Attorney, Agent, or Firm*—Morton J. Rosenberg; David I. Klein

[57] ABSTRACT

This invention relates to an acoustic board and in particular to one which includes a framework, a front panel formed with a plurality of openings and fitted on one side of the framework, a rear panel fitted on the other side of the framework thereby forming a space between the front panel and the rear panel, a plurality of sound collecting cylinders each fitted with an opening of the front panel and having an open end at the same side of the front panel, and a plurality of silencers formed with a plurality of perforations and embedded into the other end of the sound collecting cylinder.

2 Claims, 3 Drawing Sheets

ACOUSTIC BOARD

BACKGROUND OF THE INVENTION

It is found that various conventional acoustic boards have been developed to the meet the increasing need of isolating a noise from one side to the other. However, same are too bulky in volume and difficult to construct while others are too expensive for most people.

Therefore, it is an object of the present invention to provide an acoustic board which may obviate and mitigate the above-mentioned drawbacks.

SUMMARY OF THE INVENTION

This invention relates to an improved acoustic board.

It is the primary object of the present invention to provide an acoustic board which can effectively isolate the noise from one side to the other.

It is another object of the present invention to provide an acoustic board which is compact in size.

It is still another object of the present invention to provide an acoustic board which is economic to produce.

It is still another object of the present invention to provide an acoustic board which is easy to construct.

Other objects and merits and a fuller understanding of the present invention will be obtained by those having ordinary skill in the art when the following detailed description is read in conjunction with the accompanying drawings.

DETAILED DESCRIPTION OF THE PREFERRED EMBODIMENT

Figure 1:
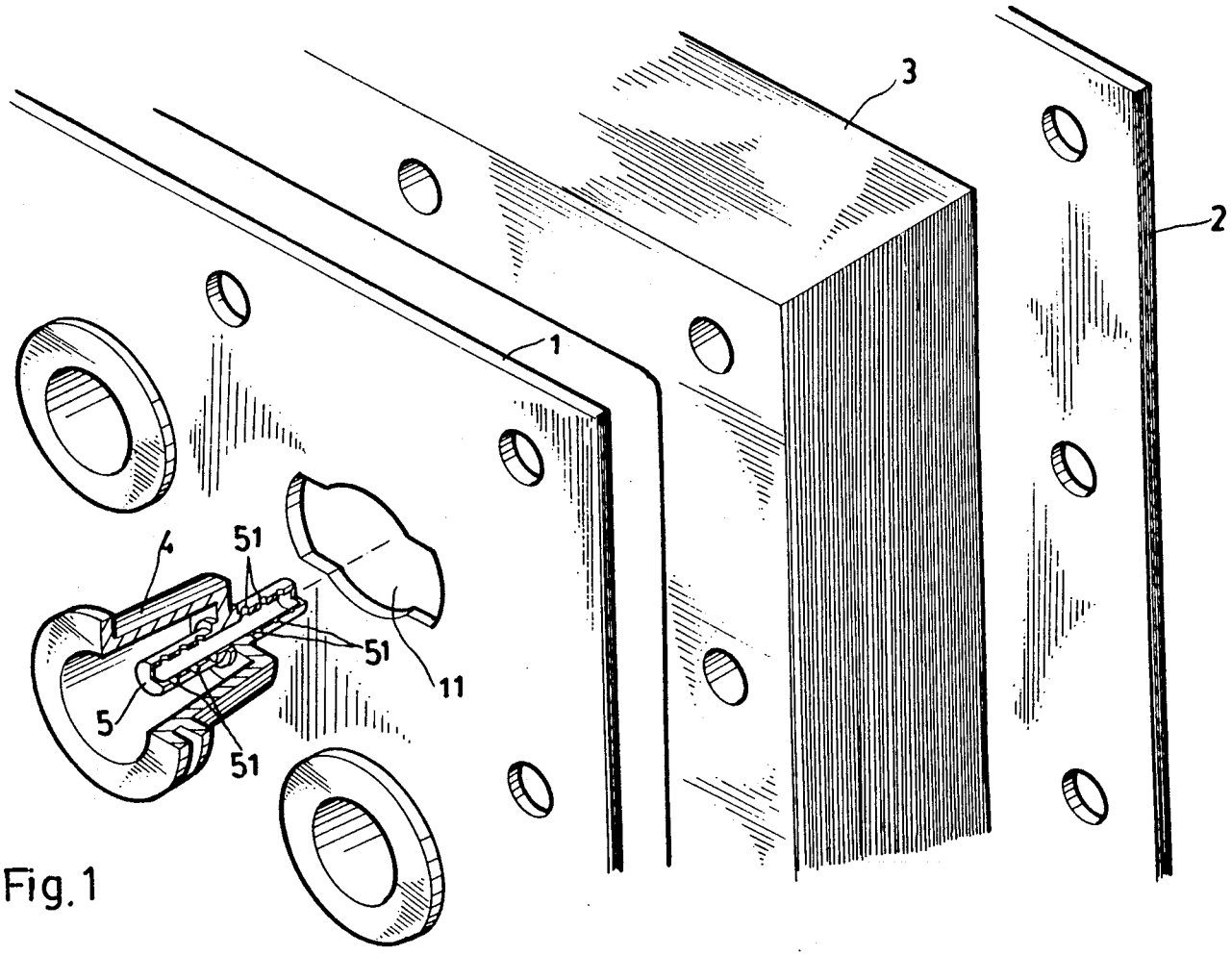
FIG. 1 is an exploded view of an acoustic board according to the present invention.

With reference to the drawings and in particular to FIG. 1, the acoustic board according to the present invention mainly comprises a front panel 1, a rear panel 2, a framework 3, a plurality of sound collecting cylinders 4 and a plurality of silencers 5.

Figure 2:
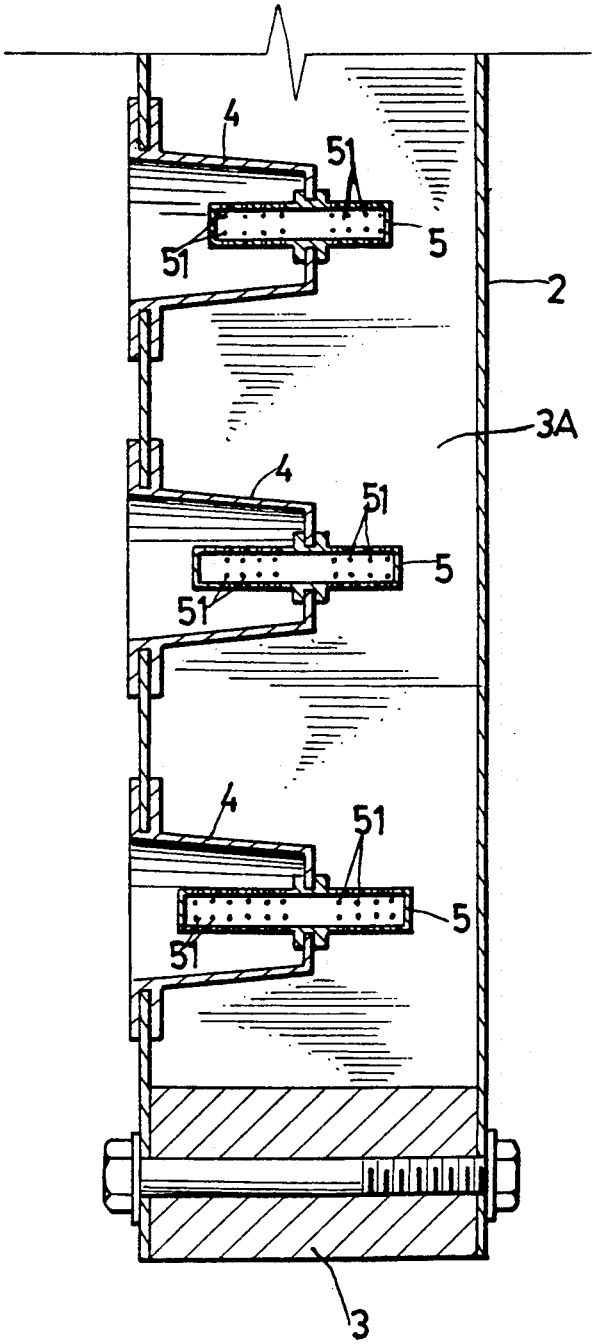
FIG. 2 is a cross-sectional view thereof.
Figure 3:
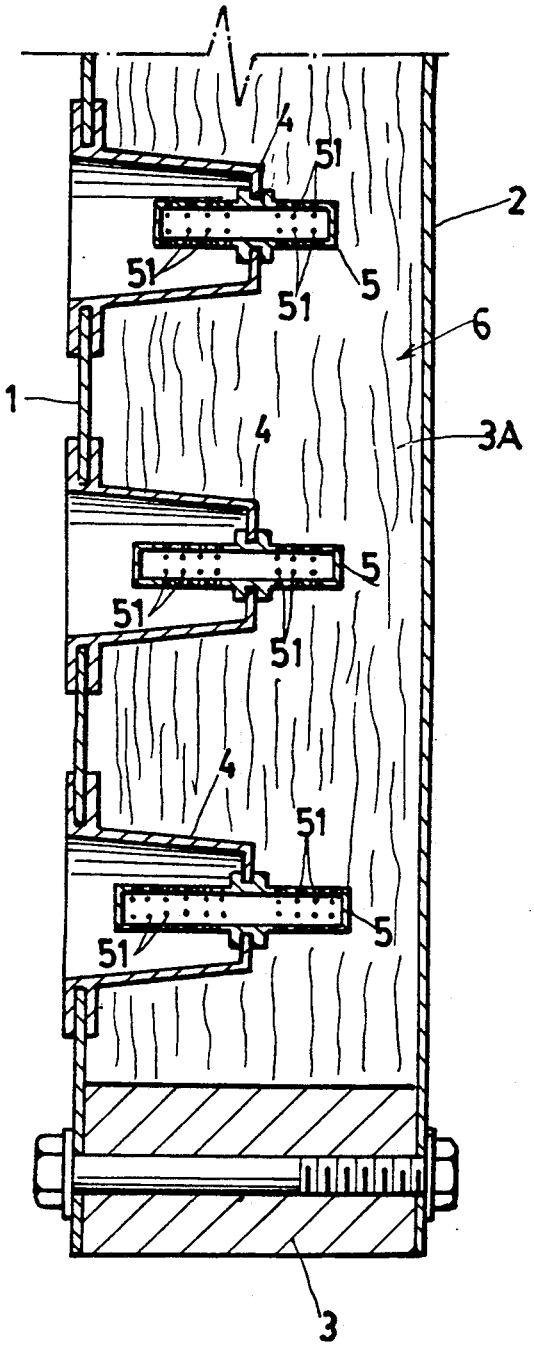
FIG. 3 is a cross-sectional view of acoustic board showing acoustic sound absorbing material therein.

As is seen in FIG. 2, the front panel 1 is provided with a plurality of openings 11 while the rear panel 2 is simply a flat member. The framework 3 is disposed between the front panel 1 and the rear panel 2 so that the front panel 1 and the rear panel 2 are respectively mounted on the front side and rear side thereof by bolts or the like (not shown). Hence, a space 3A is formed between the front panel 1 and the rear panel 2. Further, acoustic absorption material may be filled into the space 3A as shown in FIG. 3.

The sound collecting cylinder 4 is a conical member with an open side and a flange 41 for engaging with the opening 11 of the front panel 1.

The silencer 5 is a tubular member which is formed with a plurality of perforations 51 and embedded into the other end of the sound collecting cylinder 4 such that the silencer 5 extends through the sound collecting cylinder 4 at one end and into the space 3A of the framework 3 at the other. The length of the silencer 5 may be made longer or shorter so as to adapt to a certain frequency.

As stated above, the sound is first filtered by the silencer 5 and then decreased in magnitude by the space 3A of the framework 3 thereby effectively isolating the sound from one side to another.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An acoustic board comprising:

a framework;

a front panel formed with a plurality of openings and fitted on one side of said framework;

a rear panel fitted on another side of said framework thereby forming a space between said front panel and said rear panel;

a plurality of sound collecting cylinders having an open front end and a closed second end, each fitted within respective openings of said front panel and having said open end aligned with said openings of the front panel; and a plurality of silencers formed with a plurality of perforations and extended through and supported in an opening provided in said second end of the sound collecting cylinder.

2. The acoustic board as claimed in claim 1, wherein the space between said front panel and said rear panel is filled with acoustic absorption material.

* * * * *